US011203952B2

(12) United States Patent
Warren et al.

(10) Patent No.: US 11,203,952 B2
(45) **Date of Patent: *Dec. 21, 2021**

(54) OPPOSED PISTON ENGINE WITH VARIABLE COMPRESSION RATIO

(71) Applicants: James C. Warren, Alexandria, VA (US); Scott G Jorda, Westminster, MD (US); Dennis K Scheer, Birmingham, MI (US)

(72) Inventors: James C. Warren, Alexandria, VA (US); Scott G Jorda, Westminster, MD (US); Dennis K Scheer, Birmingham, MI (US)

(73) Assignee: Enginuity Power Systems, Inc

( * ) Notice: Subject to any disclaimer, the term of this patent is extended or adjusted under 35 U.S.C. 154(b) by 0 days.

This patent is subject to a terminal disclaimer.

(21) Appl. No.: 16/401,403

(22) Filed: May 2, 2019

(65) Prior Publication Data

US 2019/0257217 A1 Aug. 22, 2019

Related U.S. Application Data

(63) Continuation of application No. 13/436,833, filed on Mar. 30, 2012, now Pat. No. 10,280,810.

(60) Provisional application No. 61/469,272, filed on Mar. 30, 2011.

(51) Int. Cl.

| | |
|---|---|
| ***F01L 1/00*** | (2006.01) |
| ***F01B 7/14*** | (2006.01) |
| ***F02B 75/28*** | (2006.01) |
| ***F01L 5/04*** | (2006.01) |
| ***F01L 5/06*** | (2006.01) |

(52) U.S. Cl.
CPC ..... *F01L 1/00* (2013.01); *F01B 7/14* (2013.01); *F01L 5/04* (2013.01); *F01L 5/06* (2013.01); *F02B 75/282* (2013.01)

(58) Field of Classification Search
CPC ... F02B 75/282; F02B 4/14; F01L 1/00; F01L 5/04; F01L 5/06
See application file for complete search history.

(56) References Cited

U.S. PATENT DOCUMENTS

| | | | | |
|---|---|---|---|---|
| 6,857,401 | B1 * | 2/2005 | Styron | F02B 75/045 123/48 B |
| 7,559,298 | B2 | 7/2009 | Cleeves | |
| 10,280,810 | B2 * | 5/2019 | Warren | F01L 1/00 |
| 2004/0211374 | A1 * | 10/2004 | Kamiyama | F02B 75/041 123/78 R |
| 2008/0053420 | A1 | 3/2008 | Kamiyama | |

* cited by examiner

*Primary Examiner* — Kevin A Lathers
(74) *Attorney, Agent, or Firm* — Capitol Patent & Trademark Law

(57) ABSTRACT

An inventive opposed piston engine is provided. The inventive engine includes an inventive mechanism that enables adjustment of a compression ratio of the engine.

8 Claims, 14 Drawing Sheets

OPPOSED PISTON ENGINE WITH VARIABLE COMPRESSION RATIO

CROSS REFERENCE TO RELATED APPLICATIONS

This application claims the benefit of priority of U.S. non-provisional application Ser. No. 13/436,833 filed Mar. 30, 2012 (the "'833 Application") and U.S. provisional application Ser. No. 61/469,272, filed on Mar. 30, 2011 (the "'272 Application"). This application incorporates by reference herein the entire disclosures of the '833 and '272 Applications as if set forth in full herein.

SUMMARY OF THE INVENTION

In one aspect of the embodiments of the present invention, an opposed piston engine is provided including a mechanism enabling adjustment of a compression ratio of the engine.

DETAILED DESCRIPTION

Figure 1:
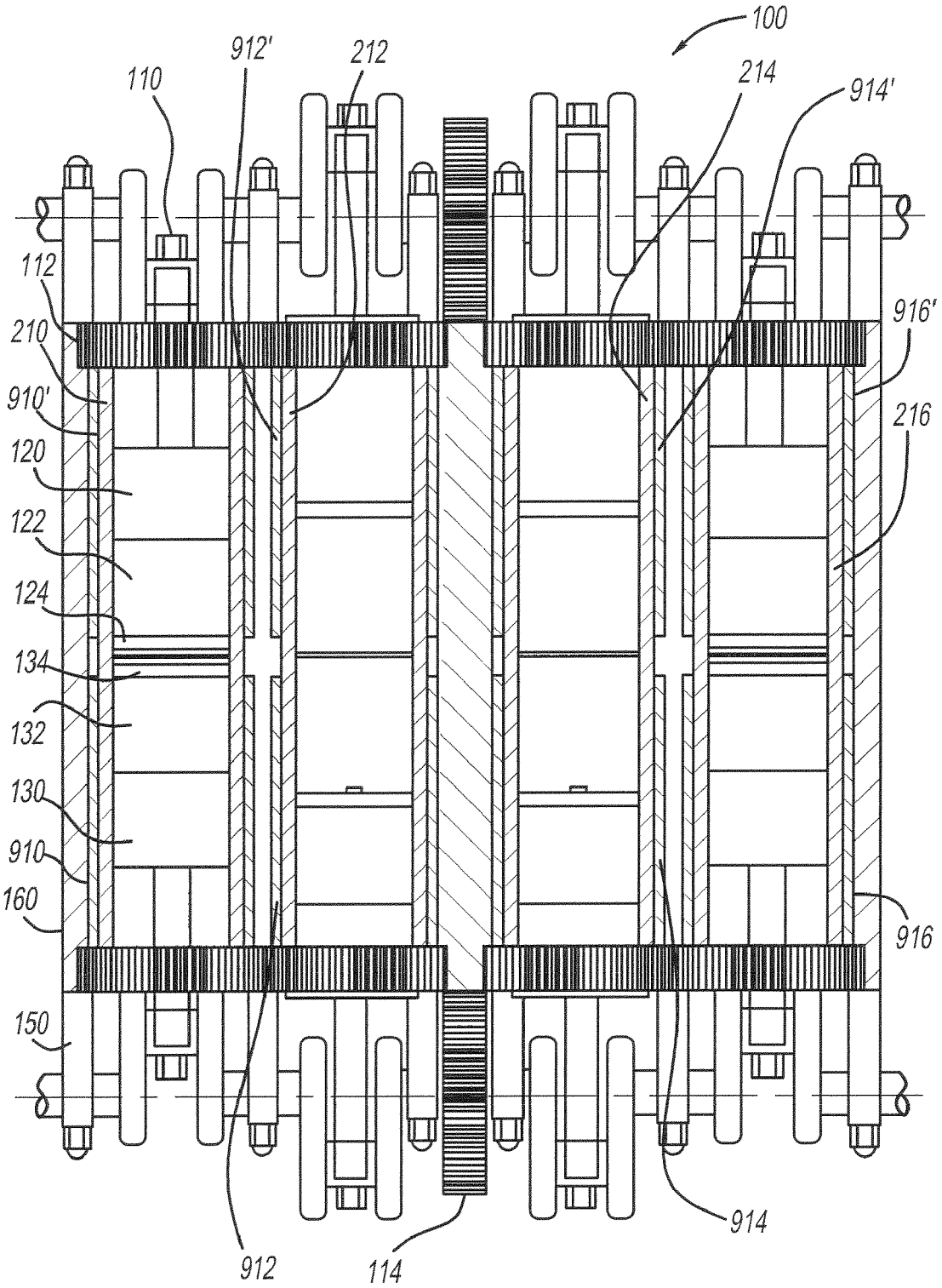
FIG. 1 is a cross-sectional view of an example of an opposed piston engine according to the present invention.

Similar reference characters denote corresponding features consistently throughout the attached drawings.

Figure 2:
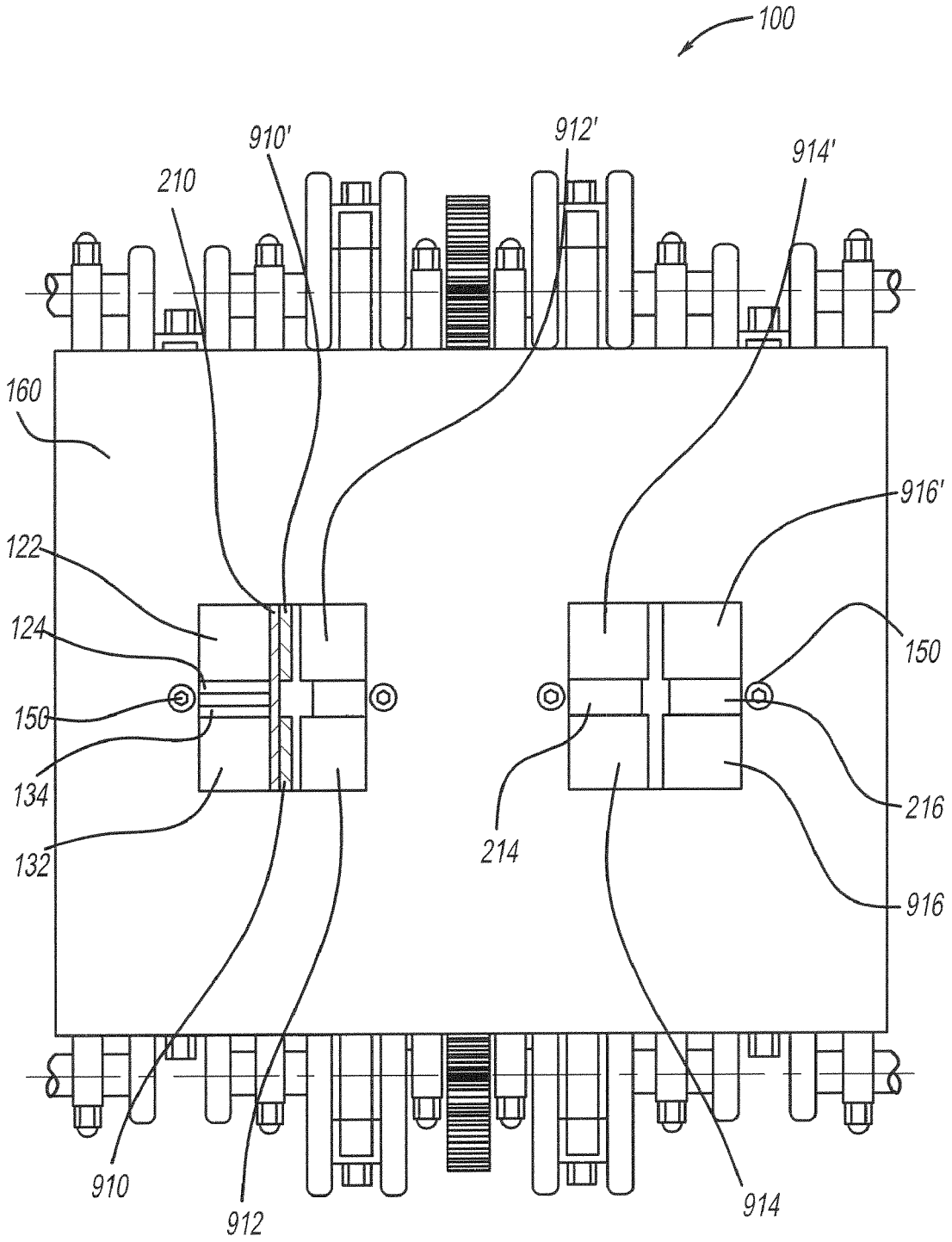
FIG. 2 is a top view of the opposed piston engine shown in FIG. 1.
Figure 3:
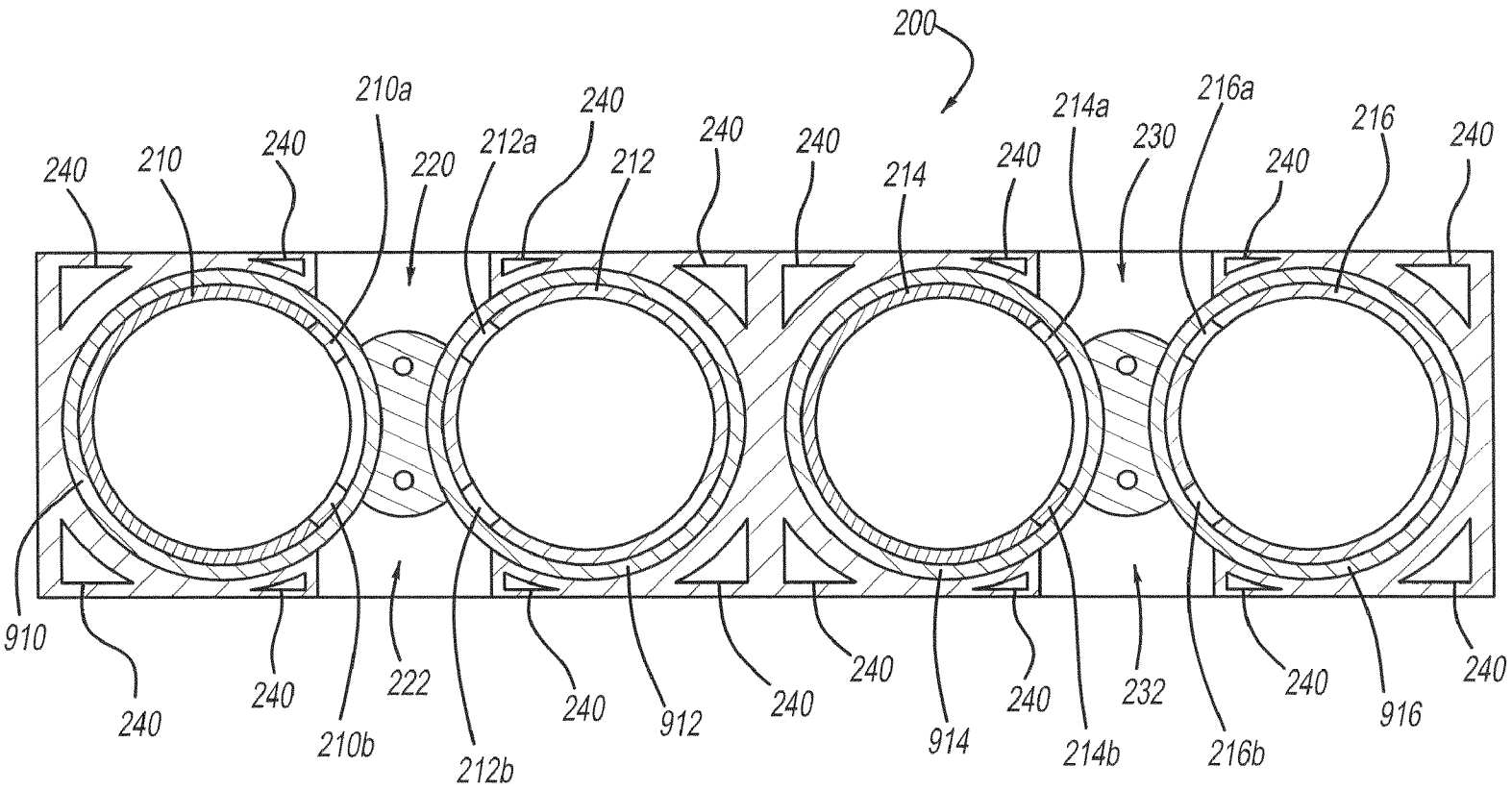
FIG. 3 is a cross sectional view of an example of a block of an opposed piston engine according to the present invention.
Figure 4:
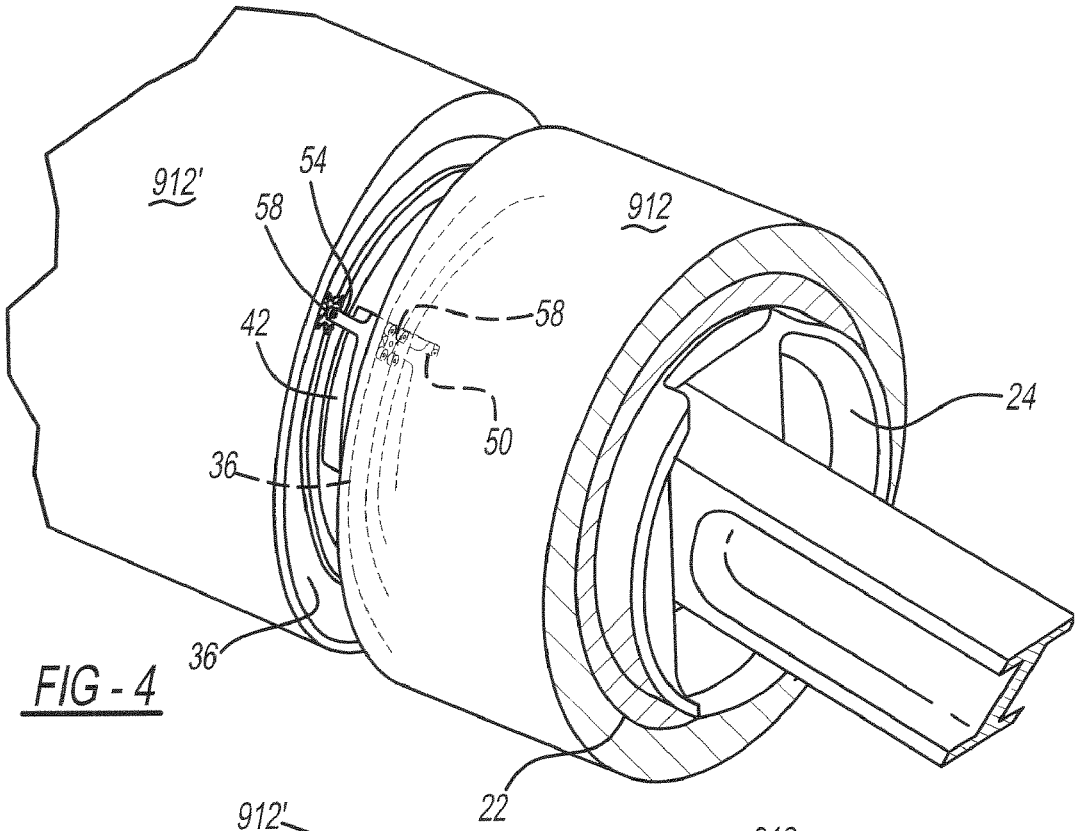
FIG. 4 is a broken away perspective view of the center of a single cylinder assembly of an opposed piston engine, providing further details of the valve mechanism.
Figure 5:
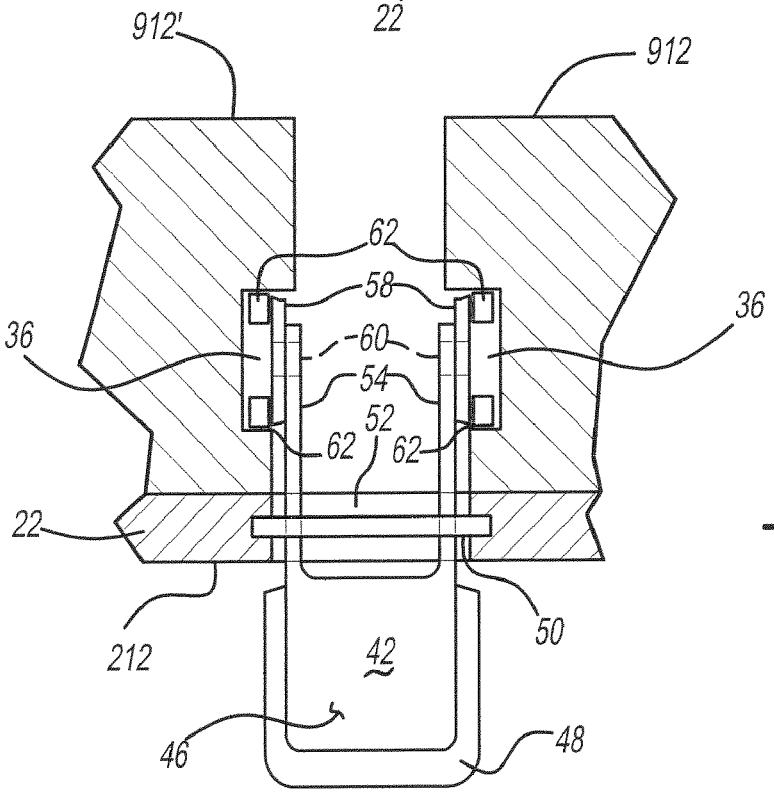
FIG. 5 is an elevation view in section through the central cylinder wall forming one side of the combustion chamber of the engine, showing further details of the valve assembly.

Referring to the drawings, an opposed piston engine according to one embodiment of the present invention is shown in FIGS. 1-3. The arrangement shown is similar to embodiments of an opposed piston internal combustion engine described in. U.S. Pat. No. 7,004,120, incorporated herein by reference. The embodiment 100 of the opposed piston engine shown in FIGS. 1-3 is a four-cycle or four-stroke engine and while it is illustrated with four cylinders 210, 212, 214, and 216, any number of cylinders may be utilized depending on the amount of power desired to be produced by the engine 100. In addition, the structural arrangements and operating principles described herein may alternatively be applied to a two-stroke engine.

Referring to FIG. 1, each cylinder 210,212,214, and 216 of the engine forms (in conjunction with opposed pistons 120 and 130 disposed within the cylinder) a combustion chamber for the air-fuel combustion reaction. Each cylinder is associated with a respective pair of rotating outer sleeves 910, 910', 912,912', 914,914', and 916, 916' (e.g., sleeves 910 and 910' enclose cylinder 210 in FIG. 1). FIG. 1 shows rotating sleeves 912, 912' associated with cylinder 212, sleeves 914, 914' associated with cylinder 214, and sleeves 916,916' associated with cylinder 216. An engine block or cylinder case 160 of the engine encloses the cylinder assemblies and opposed pistons. Each sleeve has camming surfaces formed in end portions thereof for purposes described in greater detail below. Each cylinder is also associated with a pair of connecting rods 110, a pair of opposing gears 112, opposing first and second pistons 120 and 130 that are each interconnected with one of connecting rods 110, first and second opposing piston caps 124 and 134, and a pair of bearing caps 150. Optional first and second opposing cylindrical spacers 122 and 132 may be affixed to respective ones of the opposed pistons for purposes described below.

A gear 112 is attached to each end of an associated rotating sleeve and is driven by a gear 114 sharing the same axis as the associated crankshaft (not shown), to rotate the sleeve. Each associated crankshaft is configured to provide predetermined stroke lengths to the first and second pistons 120 and 130 residing within each cylinder. The opposed first and second pistons 120 and 130 may be of a relatively standard design, and may have predetermined lengths and predetermined diameters.

Cylinders 210,212,214,216 reside within respective outer sleeves 910,910', 912,912', 914,914', and 916,916' as shown in FIG. 1. Cylinders 210,212,214,216 are also stationary with respect to the rotating sleeves. The gears 112 are configured to rotate each associated sleeve at a speed of one half crank speed, and each sleeve has a predetermined length. The sleeves of each pair of sleeves associated with an individual cylinder rotate in conjunction with each other, at the same speed and in the same direction. Sleeve or plain bearings (not shown) or any other suitable bearings may be positioned between the cylinders and their respective sleeves to facilitate rotation of the sleeves with respect to the cylinders. Similarly, sleeve or plain bearings (not shown) or any other suitable bearings may be positioned between the rotating sleeves and the engine block 160 to facilitate rotation of the sleeves with respect to the engine block 160. One source of suitable bearings for this application is GGB Bearings of Thorofare, N.J.

Referring to the arrangement within cylinder 210 of FIG. 1 as exemplary, optional first and second cylindrical spacers 122 and 132 may be affixed to the face of the associated pistons 120 and 130. The optional spacers 122 and 132 are not necessary but may be utilized to provide correct piston lengths for controlling spacing between the piston faces, thereby providing a means for adjusting the compression ratio and generally providing a predetermined degree of compression for heating intake air to facilitate combustion of a fuel injected or otherwise inserted into the combustion chamber. The piston lengths are geometrically determined in accordance with the piston stroke length and the lengths of apertures (described below) formed in the cylinders through which flow exhaust gases and air for combustion.

Referring again to cylinder 210 of FIG. 1, first and second piston caps 124 and 134 are attached to faces of associated ones of pistons 120 and 130 (or to associated optional cylindrical spacers 122 and 132 in an embodiment where spacers are used). In one embodiment, each piston cap 124 and 134 is formed from a sandwich of two sheets of carbon fiber with a ceramic center. The piston caps 124 and 134 which are exposed to the combustion event are slightly concave in form so that when the two piston caps 124 and 134 meet in the center of the cylinder they form a somewhat spherical combustion chamber. Only the ceramic cores of the piston caps 124 and 134 actually come into contact with the stationary cylinder wall. A bearing cap 150 is mounted on each end of each rotating cylinder.

The piston should have a length from the fire ring to the cap suitable for keeping the piston rings out of the apertures. The optional spacers 122 and 132, and piston caps 124 and 134 each have a diameter roughly equal to the interior of the associated cylinder, and may be made of carbon fiber, ceramic, or any other suitable material to aid in minimizing thermal inefficiencies during engine operation.

An external view of the opposed piston engine 100 is shown in FIG. 2, illustrating the block 160 itself with the intake plenums exposed. In FIGS. 1 and 2, the first and second pistons 122 and 132 in the far left cylinder 210 are shown at the apex of their stroke, at which they would not be exposed during the actual operation of the engine 100.

A cross section of an engine block 200 showing two intake plenums 220 and 230, and two associated exhaust plenums 222 and 232 is illustrated in FIG. 3. Cooling channels 240 are also illustrated. Two cylinders 210 and 212 share a common intake and exhaust runner. In the embodiment shown in FIG. 3, each runner, after branching off from the plenum, extends about sixty degrees along the outside diameter of the outer cylinder and is equal in length to the combined stroke lengths of both pistons. Various other conventional components of an internal combustion engine, e.g., cooling system, mechanical fasteners, etc., are not shown in the drawings in order to provide greater clarity for the inventive features shown therein.

Referring to FIG. 3, each of cylinders 210, 212, 214, 216 has a pair of apertures or valve ports formed therealong and positioned so as to enable fluid communication between an interior of the cylinder and the associated intake and exhaust runners. Only the apertures formed along cylinder 210 will be described for simplicity. However, it will be understood that cylinders 212,214, and 216 incorporate similar features arranged so as to facilitate execution of the engine cycle described herein.

Referring to cylinder 210 of FIG. 3, the cylinder includes a pair of apertures 210*a* and 210*b* formed therein, each aperture shown as being aligned with a corresponding one of intake plenum 220 and exhaust plenum 222. In the embodiment shown in FIG. 3, apertures 210*a* and 210*b* are angularly spaced apart approximately 90° and each encompasses an arc of approximately 60°. However, other aperture sizes and angular arrangements may be used according to the requirements of a particular application. In addition, each aperture is associated with a respective valve mechanism (not shown in FIG. 3) which is actuated responsive to the portion (i.e., intake, compression, power, or exhaust) of the engine cycle occurring in the cylinder at any given moment, as described in further detail below. The cylinder valve mechanism opens to admit air into the interior of cylinder 210 for compression by pistons 120 and 130, and also opens to eject combustion exhaust from the cylinder interior after combustion has taken place. In addition, in the manner described below, cam surfaces formed in associated sleeves 910 and 910' actuate the valve mechanisms associated with each of cylinder apertures 210*a* and 210*b*.

An ignition source (not shown) is positioned within or in fluid communication with the combustion chamber. The ignition source generates a spark at an appropriate point in the engine cycle for igniting an air-fuel mixture in the combustion chamber, in a manner known in the art. Ignition sources suitable for the purposes described herein are disclosed in U.S. patent application Ser. Nos. 12/288,872 and 12/291,326, incorporated herein by reference. In addition, other, known ignition sources may be used depending on the requirements of a particular application.

Referring now to FIGS. 4-8, each valve mechanism for embodiments of the opposed piston engine described herein essentially comprises a single poppet type valve opening into the common combustion chamber between the two opposed pistons in each cylinder pair. FIGS. 4, 5, 6, 7, and 8 shown one embodiment of a valve mechanism suitable for the applications described herein. The engine configuration to which the poppet valve mechanism is adapted includes a valve rotatably coupled to the stationary cylinder, and the rotating sleeves surrounding each cylinder. The valve is pivotally attached at one side or end thereof to an edge of the valve port of the cylinder surrounding the pistons, and is actuated by an arm or arms having guides (such as rollers, projections, or other mechanisms for engaging corresponding cam tracks or channels formed in the rotating sleeves) which are captured in corresponding cam track(s) or channel(s) formed in the rotating sleeves.

The engine and valve system operate by gearing or otherwise driving the rotation of the sleeves to correspond with the reciprocation of the pistons in an associated cylinder. The cylinder valve ports extend about a portion of the circumferential periphery of the cylinder and are aligned with intake and exhaust runners as previously described, with a single valve disposed across or over each port. As the sleeves rotate about the cylinders, the guides attached to or formed on the valve actuation arms ride along the cam surfaces or tracks formed in the sleeves. The cam track(s) vary in height or radial distance from the center of the cylinder in their path(s) about the cylinder. As the valve guide(s) travel along the variable radius cam track(s), the valve is periodically pushed inwardly toward the center of the cylinder to open the valve port, and alternately lifted away from the inward position to close the valve port of the inner cylinder. The opening and closing of the valve port permits inflow of intake charges and outflow of exhaust gases from the combustion chamber.

Details of the structure and operation of various embodiments of the valve mechanisms are now described with reference to FIGS. 4-7*b*. FIGS. 4-7*b* illustrate a portion of only a single one 912' of the rotary outer sleeves and a single stationary cylinder 212 with a single piston 120 shown therein, in order to simplify the illustrated mechanism and clarify a valve mechanism in accordance with embodiments of the present invention.

As seen in FIGS. 4-7*b*, in one embodiment, separate valve ports 212*a*, 212*b* are formed in the cylinder 212 opposite each of the intake manifold and the exhaust manifold, as previously described. The valve ports 212*a*, 212*b* are located in the inner cylinder approximately medially of each piston pair, i.e., proximate and in fluid communication with the combustion chamber defined by the cylinder 212 and its two opposed pistons 120 and 130.

In the embodiment shown in FIGS. 4-7, valve mechanisms 42 and 44 used are similar to the cam-actuated valves described in U.S. Application Ser. No. 60/561,353, incorporated herein by reference. These valve mechanisms include valve members that are connected via hinges to the cylinders and which are actuated as described in the incorporated U.S. Patent Application, by engagement between actuating members, cam following members, and cam channels formed in the rotating sleeves of embodiments of the present invention. Other suitable alternative valve mechanisms may be used.

In the embodiment shown in FIGS. 4-7, each of the valve mechanisms 42 and 44 essentially comprises a curved plate having a combustion chamber face 44 with a curvature closely conforming to the curvature of the internal cylinder wall 40. Each valve mechanism further includes aback 46 opposite the face 44, and a sealing periphery 48. First and second pairs of opposed actuating arms 54 and 55 extend from the back of the valve. The pairs of actuating arms 54 and 55 extend outwardly adjacent to opposite sides of the inner cylinder valve port 38.

A first valve attachment hinge 50 connects one edge of the valve periphery 48 to actuating arms 54, while a second valve attachment hinge 51 connects an opposite edge of the valve periphery 48 to actuating arms 55. Thus, each of the actuating arms is connected to the back of the valve via a hinge or other mechanism permitting relative rotation between the respective arm and the valve back 46.

Referring again to FIGS. 4-7, each of the actuating arms in pairs 54 and 55 terminates in a distal end having a cam follower mechanism 58 extending therefrom and riding in corresponding cam channels 36 of the sleeves 912, 912'. In the embodiment shown, the cam follower mechanism is resiliently attached to the distal end 56 of the actuating arm 54 by a resilient bushing connector 60 or the like that permits limited relative movement between the can follower mechanism 58 and the actuating arm 54. This provides allowance for any small tolerance buildups or dimensional changes due to thermal expansion as the engine 100 is operated. The cam follower mechanism includes at least one cam channel roller 62 extending therefrom and riding within a corresponding cam channel 36.

In the embodiment shown in FIGS. 4-7, the cam follower mechanism 58 is in the form of a "spider" having a series of radially extending anus, with each of the arms having a separate roller 62 extending therefrom. The rollers 62 comprise small roller bearings that ride against the corresponding inner and outer surfaces of the cam channels 36. As the radius of the cam channels 36 vary around the cylinder 22, the rollers are forced radially inwardly and outwardly, thereby driving their attached cam follower mechanisms 58 and valve actuating arms 54 inwardly and outwardly to open and close the valve 42. Other, alternative methods of valve actuation are also contemplated. As described in greater detail below, the sleeves 912 and 912' rotate to actuate the valves 42 and 44, thereby enabling fluid communication between the interior of cylinder 212 and the separate intake and exhaust passages.

Referring to FIGS. 4-7, the rotating sleeve 912' includes at least one cam channel 36 formed therein. The cam channel(s) 36 formed in rotating sleeve 912' have variable radii in order to actuate the valve mechanism during rotation of the outer cylinder, as described in detail further below.

In one embodiment, a single cam channel 36 is provided in sleeve 912' for guiding the cam follower mechanism 58. However, in the particular embodiment shown in FIGS. 4-7, it will be understood that a symmetrical valve actuation system of at least two opposed circumferential cam channels 36 in sleeves 912 and 912' and corresponding symmetrically opposed linkages between the cam channels and the valve, is provided.

FIGS. 4-7 illustrate the sequence of valve operation through essentially one clockwise revolution of the sleeve 912' about the stationary cylinder 212. The variable radius cam channel 36 includes a larger radius valve closed portion 36*a*, a decreasing radius ramp portion 36*b* causing each of valves 42 and 44 to move from a closed to an open position, a relatively smaller radius valve open portion 36*c*, and an increasing radius ramp portion 36*d* which causes the valves to move from open positions to its closed positions along the larger radius channel portion 36*a*.

Operation of the sleeves and valves during the engine cycle is described as follows, with reference to cylinder 212 and associated sleeves 912, 912'. It will be understood that the remainder of the sleeves and valves also operate in the manner described.

Figure 6:
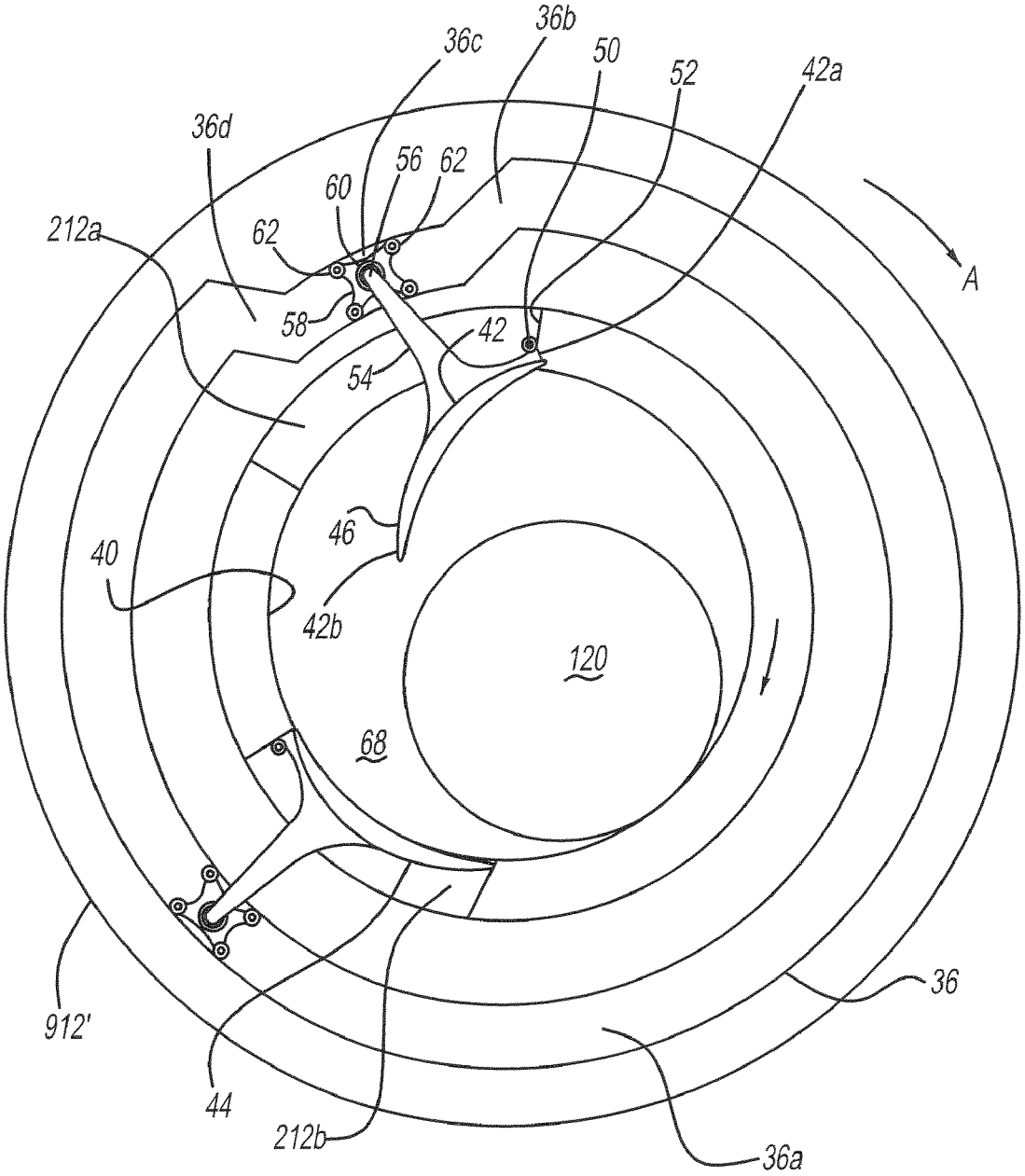
FIG. 6 is a cross-sectional view across a single combustion chamber of the engine, showing the rotation of a sleeve and resulting actuation of the valve during the intake portion of the engine cycle.

Referring to FIG. 6, at the beginning of the combustion cycle, exhaust gasses have been purged and the pistons and associated piston caps within cylinder 212 are at top dead center. FIG. 6 shows a configuration of one sleeve 912' of the system during an intake stroke of the cycle. As seen in FIG. 6, the sleeve 912' rotates within the cylinder case 160 in the direction indicated by arrow "A", thereby causing the cam channels engaging the valve actuating mechanism 58 to travel around the circumference of the cylinder 212. As the sleeve 912' rotates and the radius of the cam channel 36 with respect to cylinder 212 varies, so does the distance between the valve actuating mechanism 58 and the center of the cylinder 212 as the outer cylinder rotates.

One edge 42*a* of the valve 42 is fixed at a substantially constant radius from the center of the cylinder 212 due to the valve hinge mechanism 50 and the movement of cam follower mechanism 58 within cam channels 36. However, an opposite edge 42*b* of valve 42 is forced to open toward the center of the cylinder 212 as the actuating mechanism 58 reaches the smaller radius portion 36*c* of the cam channel 36. This edge of the valve rotates about the hinge mechanism 50, thereby opening the valve to admit air for compression and combustion through cylinder opening 212*a*.

As seen in FIG. 1, sleeves 912 and 912' are spaced apart. Also, as seen in FIGS. 4-7, a valve is positioned in each of cylinder openings 212*a* and 212*b* to control fluid flow through the opening, and each valve has cam followers engaging the cam surfaces in each sleeve. Thus, each valve straddles the gap between the sleeves to engage cam surfaces formed in each sleeve.

In FIG. 6, when valve 42 is forced open by rotation of the sleeves 912' and 912 (not shown in FIG. 6) and corresponding movement of the cam follower mechanism 58 along the cam channels, movement of the pistons in cylinder 212 away from each other causes air-fuel mixture to be drawn into the inner cylinder combustion chamber. When the piston caps 124 and 134 (FIG. 1) are halfway to bottom dead center, the aperture 212*a* is completely open and air has entered the interior of cylinder 212 for compression. By the time the pistons 120 and 130 are at bottom dead center, sleeves 912 and 912' have rotated in direction "A" to where the cam follower mechanism of valve 42 has engaged larger radius valve closed portions 36*a* of sleeves 912 and 912', drawing the valve actuating mechanism 58 outwardly away from the center of the cylinder 212, thereby closing the edge 42*b* of the valve 42. At this point, the compression stroke is commencing. In addition, the cam follower mechanism associated with valve 44 is engaged with larger radius valve closed portions 36*a* of sleeves 912 and 912*a*. Thus, valve 44 regulating flow between the interior of cylinder 212 and the exhaust runner is closed.

With both of valves 42 and 44 closed, as the pistons 120 and 130 within cylinder 212 are forced to the center of the cylinder, the air in cylinder 212 is compressed between the pistons. When opposed pistons 120 and 130 are at or near their points of closest approach to each other, the air in the combustion chamber has been compressed and is at or near its maximum pre-combustion temperature. At or near this point, a spar is initiated by an ignition source located within or in fluid communication with the combustion chamber, as previously described. At the same time, while pistons 120 and 130 are approaching each other, sleeves 912 and 912' continue to rotate in conjunction with each other in the direction indicated by arrow "A" of FIG. 6.

Combustion of the fuel produces expanding gases, forcing the opposed pistons in opposite directions. This initiates the power stroke of the engine cycle. It will be seen that, as cam follower mechanism 58 is traveling along the relatively larger radius portion of cam channel 36 during the compression and combustion cycles, valves 42 and 44 are closed during the compression and combustion cycles described above. During the power stroke, the pistons 120 and 130 move away from each other as the force of the expanding gasses dictates. At the same time, while pistons 120 and 130 are drawing away from each other, sleeves 912 and 912' continue to rotate in conjunction with each other in the direction indicated by arrow "A" of FIG. 6.

Figure 7:
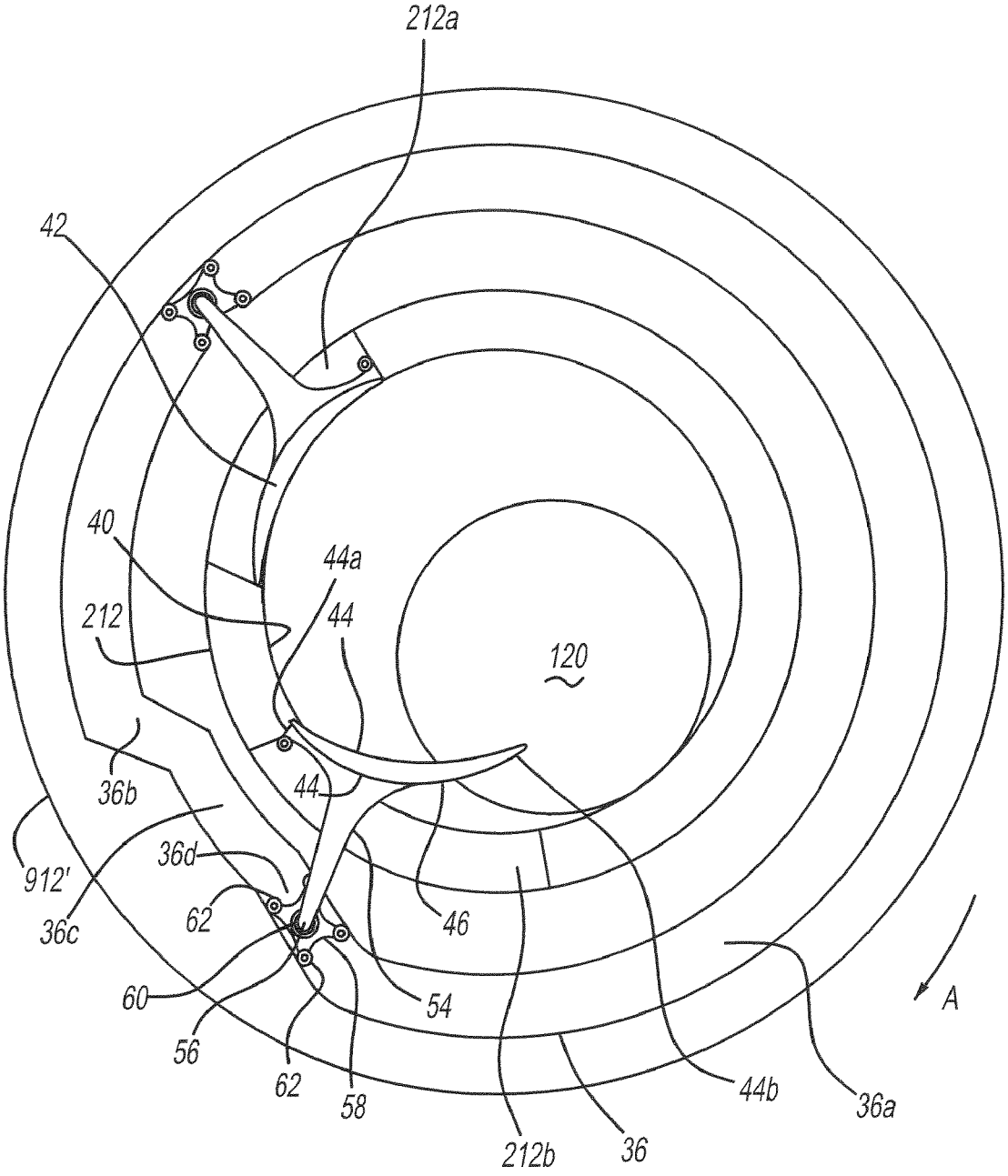
FIG. 7 is a cross-sectional view across a single combustion chamber of the engine, showing the rotation of a sleeve and resulting actuation of the valve during the exhaust portion of the engine cycle.

FIG. 7 shows a configuration of the system during an exhaust stroke of the cycle when the opposed pistons in cylinder 212 are approaching each other after completion of the power stroke. As seen in FIG. 7, the sleeves 912 (not shown in FIG. 7) and 912' rotate within the cylinder case 160 in the direction indicated by arrow "A", thereby causing the cam channels engaging the valve actuating mechanism 58 to travel around the circumference of the cylinder 212. As the radius of the cam channel 36 with respect to cylinder 212 varies, so does the distance between the valve actuating mechanism 58 and the center of the inner cylinder 22 as the outer cylinder rotates.

Figure 8:
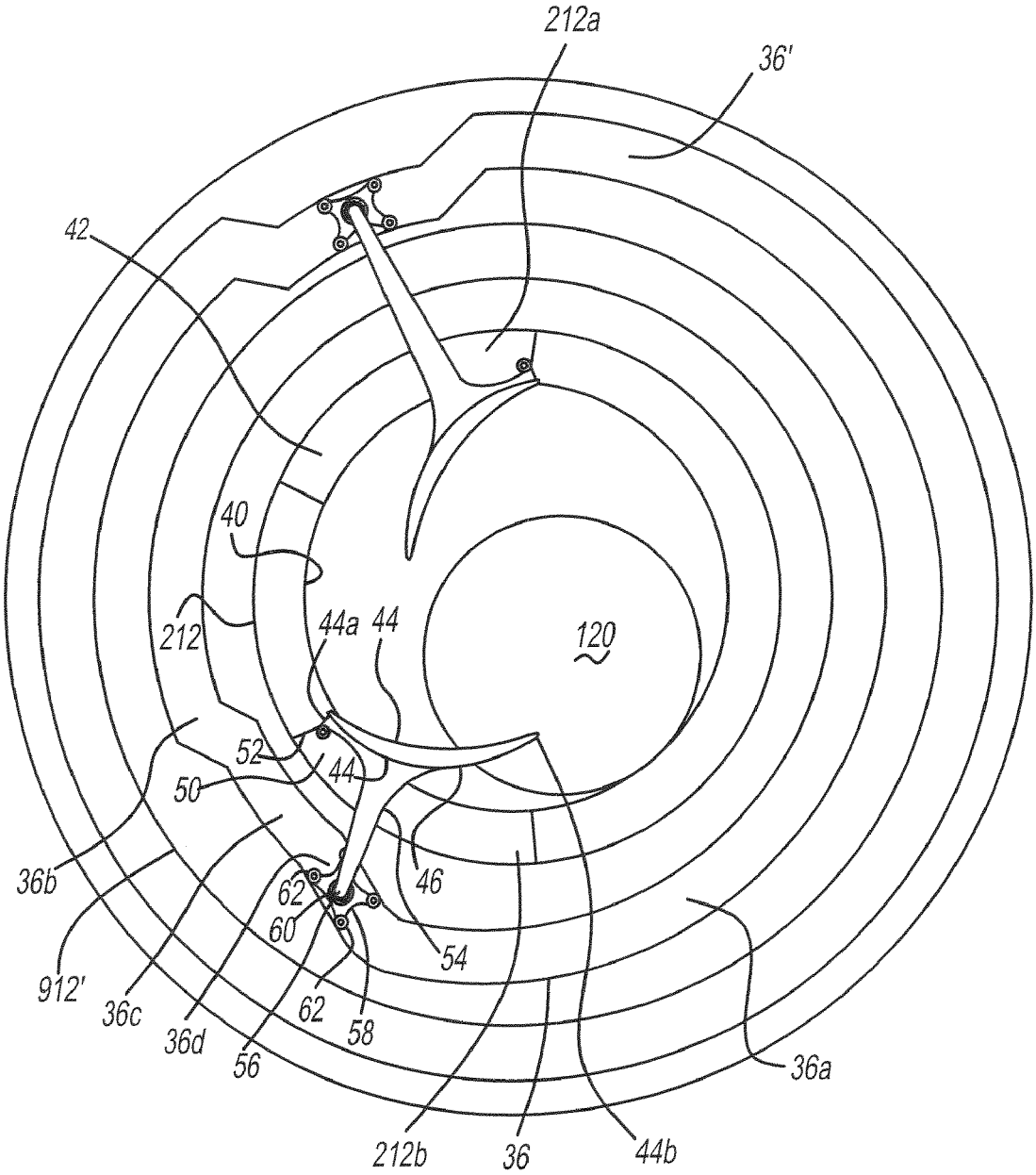
FIG. 8 shows a valve mechanism in accordance with another alternative embodiment of the present invention.

As rotation of the sleeves 912, 912' continues, the cam follower mechanism associated with valve 44 engages the decreasing radius ramp portion 36*b*, then the smaller radius valve open portion 36*e*. Edge 44*a* of the valve 44 is fixed at a substantially constant radius from the center of the cylinder 212 due to the valve hinge mechanism 50 and the movement of cam follower mechanism 58 within cam channels 36. However, edge 44*b* of valve 44 is forced to open toward the center of the cylinder 212 as the actuating mechanism 58 reaches the smaller radius portion 36*c* of the cam channel 36. This edge of the valve rotates about the hinge mechanism 50. Thus, when valve 44 is forced open by rotation of the outer cylinder and corresponding movement of the actuating arms along the cam channels, movement of the opposed pistons toward each other causes combustion products to be ejected from opening 212*b* into the exhaust runner. As the piston caps 124 and 134 of the pistons reach top dead center, the valve mechanism associated with aperture 210*b* closes, allowing a new cycle to begin. Referring to FIG. 8, in another embodiment, a separate cam channel is provided for each valve. This provides greater flexibility in controlling the valves because the valves can be actuated independently and simultaneously.

Figure 7A:
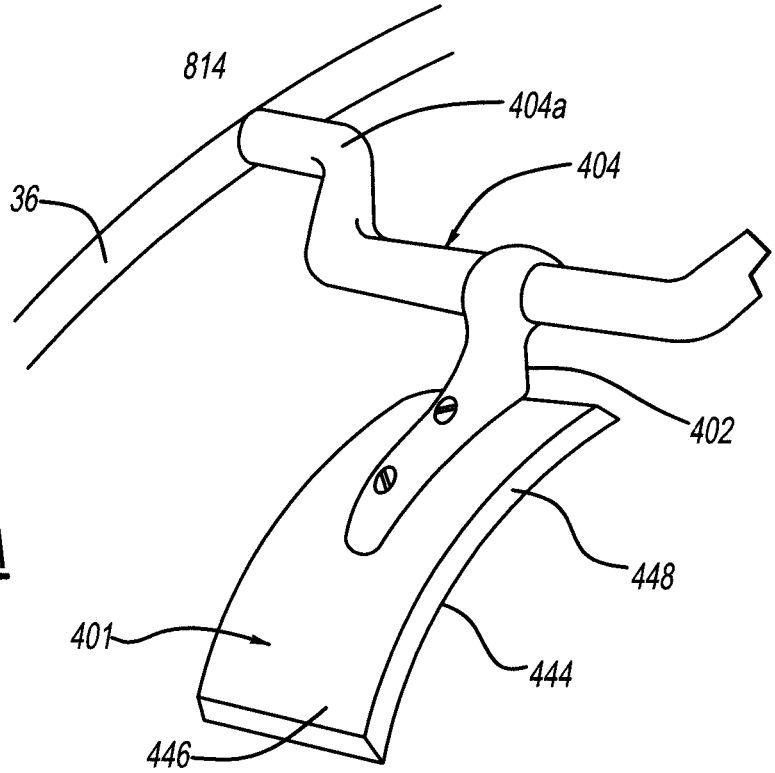
FIGS. 7A and 7B show views of a valve mechanism in accordance with an alternative embodiment of the present invention.
Figure 7B:
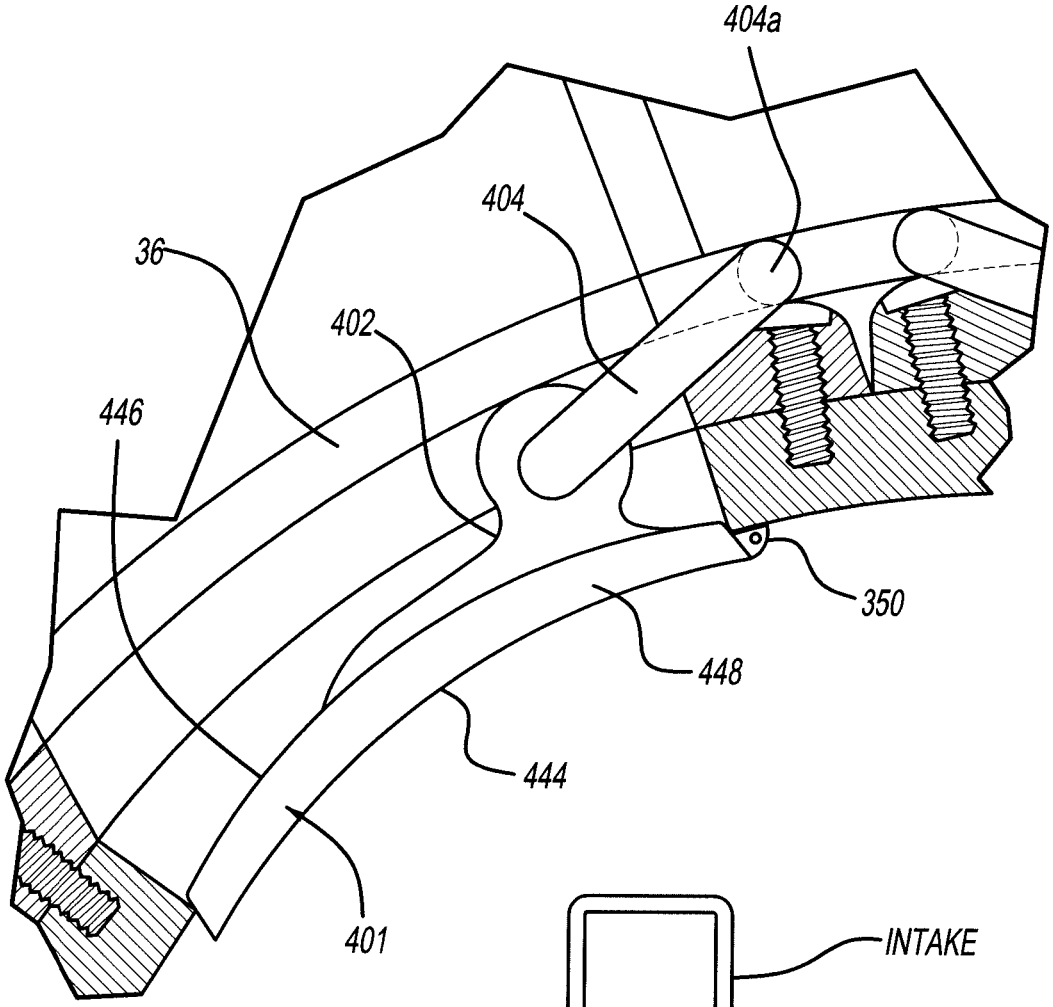
Figure 7B:
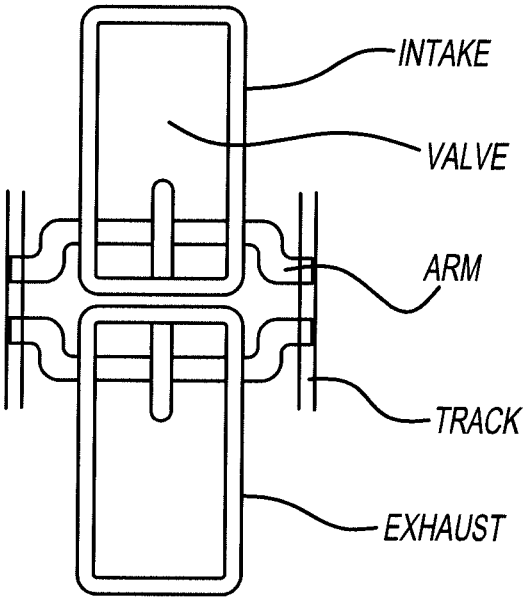

Referring now to FIGS. 7*a*-7*b*, another embodiment of the valve includes a curved plate 401 including a combustion chamber face 444, a back 446 opposite the face 444, and a sealing periphery 448 as previously described. A connector 402 is attached to plate 401, and an actuating member 404 is attached to connector 402.

In the embodiment shown, the orientation of actuating member 404 is fixed with respect to plate 401 such that the entire sub-assembly comprising plate 401, connector 402, and actuating member 404 is rotatable as a unit. In a particular embodiment, connector 402 and actuating member 404 are formed as a single piece.

Referring to FIGS. 7*a* and 7*b*, an arm 404*a* formed on each end portion of actuating member 404 moves within in a respective cam channel 36 of a corresponding one of rotating sleeves 912, 912' during rotation of the sleeves, in a manner similar to that previously described for cam follower mechanism 58. Lubrication may be provided to facilitate relative motion between the cam channel surfaces and the alms 404*a*. Any of a number of suitable lubricating mechanisms may be used, for example, graphite impregnation of the arms and/or the cam channels, application of oils or other viscous lubricants, or other lubricating methods may be used.

In another embodiment (not shown), connector 402 is rotatable with respect to actuating member 404 (i.e., the actuating member is mounted within and can rotate within connector 402).

In the embodiment shown in FIGS. 7*a*-7*b*, an edge of plate 401 is pivotably attached to a hinge mechanism 350 similar to hinge mechanism 50 previously described. Plate 401 rotates about hinge mechanism 350 during actuation of the valve to open and close the valve, as previously described.

In another embodiment (not shown), a portion of plate 401 abut or engages an edge of cylinder aperture 210*a* (or 210*b*) or an inner surface of the cylinder to form a pivot point for the plate 401 at the point of contact between the plate and the cylinder. Actuation of the valve by motion of actuating member 404 resulting from rotation of the sleeves 912, 912' produces rotation of the plate 401 about the pivot point, to open and close the valve.

Actuation of the valve embodiment shown in FIGS. 7*a*-7*b* is similar to actuation of the embodiment shown in FIGS. 4-7. As sleeves 912,912' rotate, arms 404*a* on actuating member 404 ride within respective cam channels 36, producing motion of the actuating arm and a corresponding rotation of plate 401, to open and close the valve.

In yet another embodiment (not shown), a pivot member is provided intermediate the actuating member 404 and plate 401. The pivot member, actuating member, and plate are coupled together so as to form a substantially rigid member. The pivot member is coupled to the cylinder so as to permit rotation of the rigid member about the pivot member and with respect to the cylinder. In this embodiment, engagement between the actuating member and the cam channel surfaces produces rotation of the rigid member (including the plate 401 seated in the valve aperture) about the pivoting member, to open and close the valve.

In other alternative embodiments, types of valves other than the type described above may be employed. For example, spring-loaded poppet valves may be used. These valves may be actuated as previously described, by engagement between cam channels formed in a rotating outer cylinder and actuating members, or by other features formed on the valves.

The engine may also incorporate an electronic control module (ECM) and associated sensors, as known in the art, to perform and/or facilitate engine control functions.

In an opposed piston engine in accordance with another embodiment of the present invention, the compression ratio of the engine may be adjusted according to the projected or actual demands on the engine. For example, the compression ratio may be reduced to increase or maintain fuel efficiency during periods of higher engine loading. Conversely, the compression ratio may be increased to provide fuel efficiency during periods of relatively lighter engine loading. As used herein, the term "compression ratio" is defined as the ratio of the volume between the piston and cylinder head before a compression stroke, to the volume between the piston and cylinder head after a compression stroke.

In one particular embodiment, the engine compression ratio may be adjusted to a value within a predetermined range and then maintained at substantially the desired value during engine use. Terms of degree such as "substantially," "about" and "approximately" as used herein mean a reasonable amount of deviation of the modified term such that the end result is not significantly changed.

In another particular embodiment, the engine compression ratio may be dynamically adjusted during engine use to a value within a predetermined range and then maintained at substantially the desired value for as long as required. The compression ratio may then be changed again as needed during engine use to help provide or maintain enhanced fuel economy.

Figure 9:
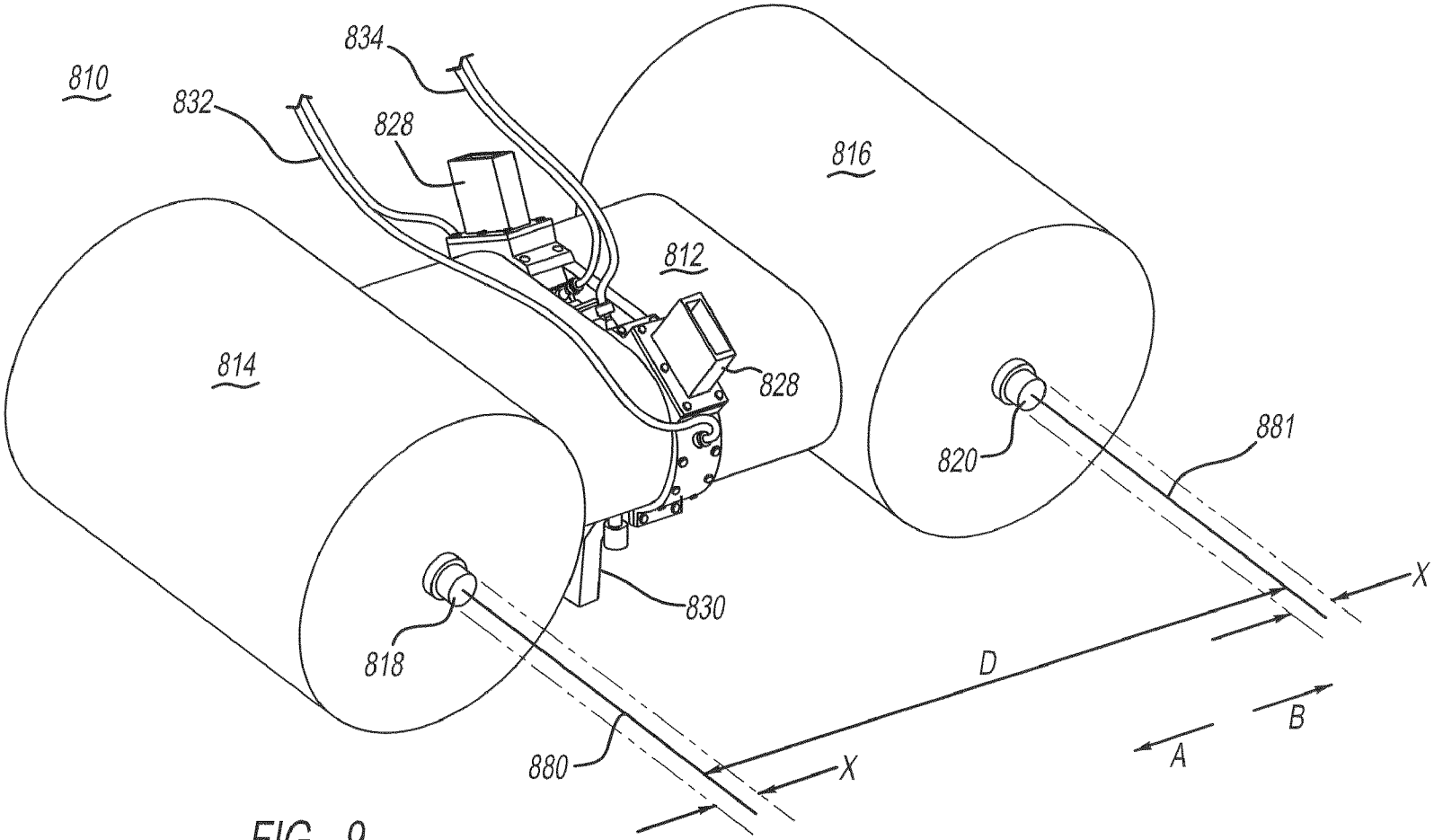
FIG. 9 is a perspective view of an opposed piston engine in accordance with another alternative embodiment of the invention.

FIG. 9 of the drawings is a perspective view of an exemplary opposed piston engine 810 permitting adjustment of the engine compression ratio. The embodiment shown is structurally similar to an embodiment shown in U.S. provisional application Ser. No. 12/007,346, incorporated herein by reference. The engine 810 includes an engine cylinder case 812 having two mutually opposed crankcases 814 and 816, with each crankcase having a crankshaft, respectively 818 and 820, installed therein. The noses of these two crankshafts are shown in FIG. 9 of the drawings, with the complete second crankshaft 820 being shown in the partial section inverted perspective view of FIG. 10. The cylinder case portion 812 of the engine 810 encloses the rotary cylinders and opposed pistons of the assembly, as shown in FIG. 10 and as previously described.

Figure 10:
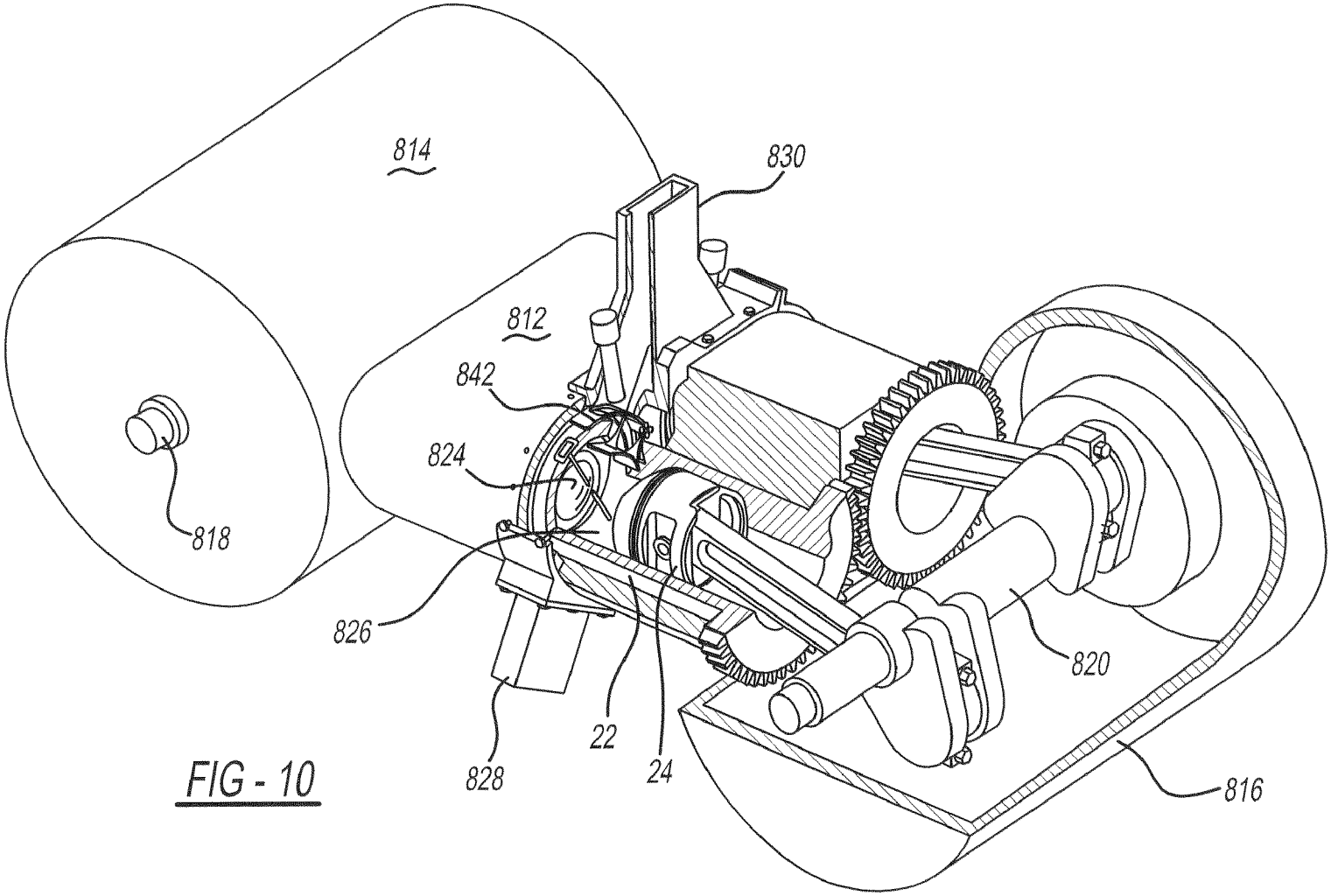
FIG. 10 is a partial cutaway view of the embodiment shown in FIG. 9.

The exemplary engine 810 of FIGS. 9 and 10 includes two pairs of opposed pistons, i.e., four pistons in two cylinders, but it will be seen that any practicable number N of cylinders with 2N pistons may be used to form various embodiments of such an opposed piston engine. FIG. 10 of the drawings shows at least a portion of both opposed pistons 824 within one of the cylinders 822, with the cylinder 822 and its two opposed pistons 824 defining a central combustion chamber 26 therebetween. The engine in this drawing has been inverted in order to show the left portion of the cylinder 822 and its left piston 824 without the otherwise obscuring intake port. The cylinder case 812 includes circumferentially or angularly spaced intake and exhaust ports, respectively 828 and 830, which deliver the fuel-air mixture (or air, in the case of direct fuel injection) to the cylinder(s) 822 and duct the spent exhaust gases from the cylinder(s). Exemplary ignition leads 832 and fuel injection lines 834 are also shown in FIG. 1. Various other conventional componentry of an internal combustion engine, e.g., cooling system, mechanical fasteners, etc., are not shown in the drawings in order to provide greater clarity for the inventive features shown therein.

In the embodiment shown in FIGS. 9 and 10, the engine is constructed so that the spacing D between the crankshaft rotational axes 801 and 801 can be varied and maintained in a controlled manner.

Referring to FIG. 11, in one particular embodiment, at least one of crankcases 814 and 816 is slidably or otherwise flexibly connected to cylinder case 812 to permit a slight adjustment of the position of an associated one of crankshafts 818 and 820 mounted therein. Suitable seals may be provided along the portions of each crankcase where the cylinder case enters.

Figure 11A:
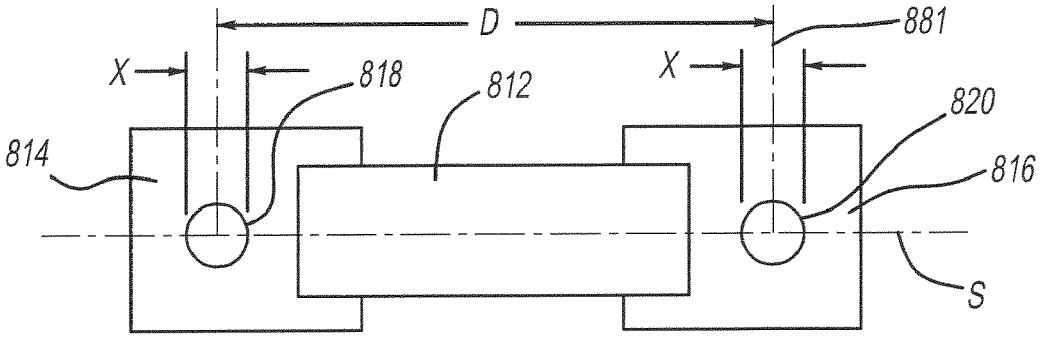
FIGS. 11A and 11B are schematic view of an operational mode of one embodiment of an opposed piston engine allowing control of the engine compression ratio.
Figure 11B:
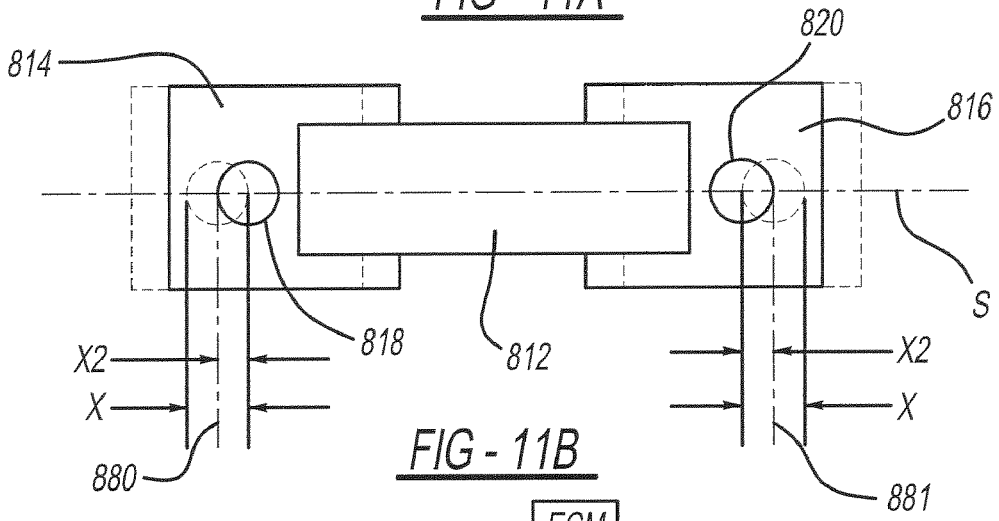

In the example shown in FIGS. 9, 11A and 11B, by varying the spacing between the crankcases 814 and 816, the spacing between the crankshafts 818 and 820 may be varied from a minimum of (D−x) to a maximum of (D+x). FIG. 11A shows the crankshafts 818 and 820 spaced apart a distance D. FIG. 11B shows the crankshafts spaced apart a distance (D−x). That is, one or more of crankshafts 818 and 820 can be moved a slight amount in either of the directions indicated by arrows "A" and "B" by moving one or both of the crankcases in which the shafts are mounted. This permits the volume inside the combustion chamber above "top dead center" of the piston to be selectively varied, thereby adjusting the cylinder compression ratio. By increasing the spacing between the centerlines, the distance between the "top dead centers" of the pistons in the chamber is correspondingly increased, and the compression ratio is reduced. Conversely, by decreasing the spacing between the centerlines, the distance between the "top dead centers" of the pistons in the chamber is correspondingly decreased, and the compression ratio is increased.

In a particular embodiment, the spacing between the crankshaft centerlines may be adjusted to any desired value over a range of several millimeters.

Figure 13A:
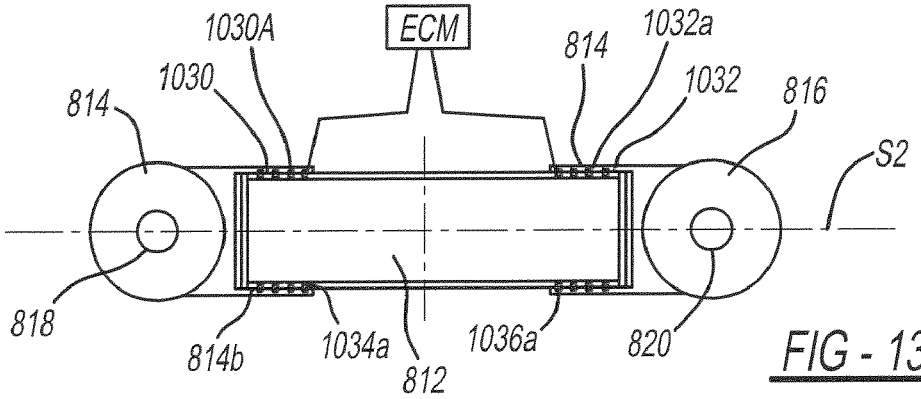
FIGS. 13A and 13B are schematic views of an engine compression ratio control mechanism in accordance with one embodiment of the present invention.
Figure 13B:
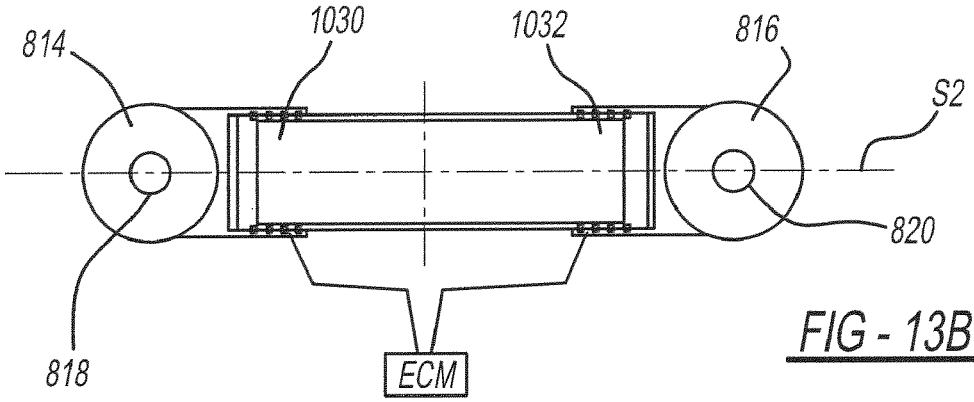

Referring to FIGS. 13*a* and 13*b*, in one particular embodiment, cylinder case 812 is connected to crankcases 814 and 816 using intermediate actuatable connection members 1030 and 1032. In one embodiment, connection members 1030 and 1032 comprise sleeves having external threaded portions 1030*a* and 1032*a* and internal threaded portions 1034*a* and 1036*a*. Threaded portion 1030*a* engages complementary internal threads 814*a* formed along an interior of the crankcase opening 814*b*. Threaded portion 1032*a* engages complementary internal threads 816*a* formed along an interior of the crankcase opening 816*b*. Similarly, internal threaded portion 1034*a* engages complementary external threads 812*b* formed along an exterior of one end of the cylinder case 812. Threaded portion 1036*a* engages complementary external threads 816*b* formed along an exterior of an opposite end of the cylinder case 812.

Each of connection members 1030 and 1032 is rotatable between the cylinder case 812 and a respective one of the crankcases 814 and 816. The threaded connections between the cylinder case, the crankcases, and the connection members are configured so that rotation of either threaded connection members 1030 and 1032 causes an associated one of crankcases 818 and 820 to move in one of directions "A" or "B". The connection members 1030 and 1032 may be coupled to any suitable actuation mechanism (for example, a gear, a servomechanism, or any other another suitable mechanism).

In addition, the threaded connections between the cylinder case, the crankcases, and the connection members may be configured so that rotation of either of connection members 1030 and 1032 through a predetermined arc will produce a corresponding predetermined linear movement of the associated crankcase. In one particular embodiment, rotation of a connection member through an arc of 90° produces a linear movement of an associated crankcase of 4 millimeters.

In another embodiment (not shown), a single connection member is provided between the cylinder case and an associated crankcase for controlling linear movement of a single crankcase along axis S2.

Referring to FIG. 12*a*-12*b*, 14*a*-14*b*, 15*a*-15*b*, and 16*a*-16*b*, in another particular embodiment, at least one of crankshafts 818 and 820 is slidably or otherwise movably mounted within their respective crankcases 814 and 816 to permit a slight adjustment of the spacing (over a distance "X" as shown in FIG. 9) between the rotational axes 880 and 881 of crankshafts 818 and 820. That is, one or more of crankshafts 818 and 820 can be moved a slight amount in either of the directions indicated by arrows "A" and "B" using a suitable linear actuation means operatively coupled to portions of the shaft. This permits the volume inside the combustion chamber above "top dead center" of the piston to be selectively varied, thereby adjusting the cylinder compression ratio. The mountings connecting the shafts to the crankcases may be configured to accommodate the desired linear movement of the crankshafts along an axis S connecting the rotational centerlines of the shafts, as shown in FIG. 11 or axis S2 in FIGS. 12*a* and 12*b*.

Figure 12A:
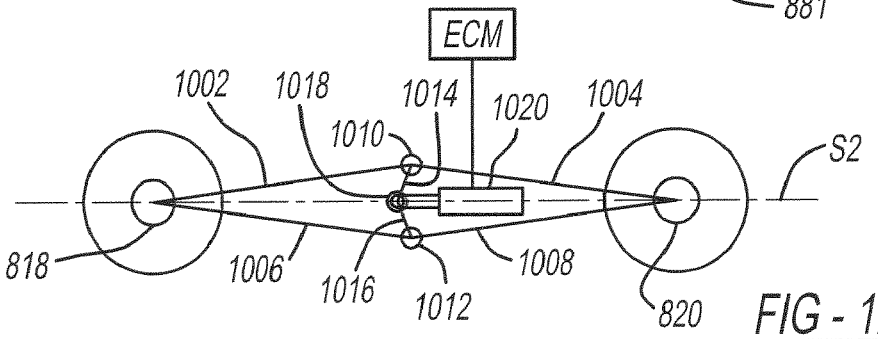
FIGS. 12A and 12B are schematic views of an engine compression ratio control mechanism in accordance with one embodiment of the present invention.
Figure 12B:
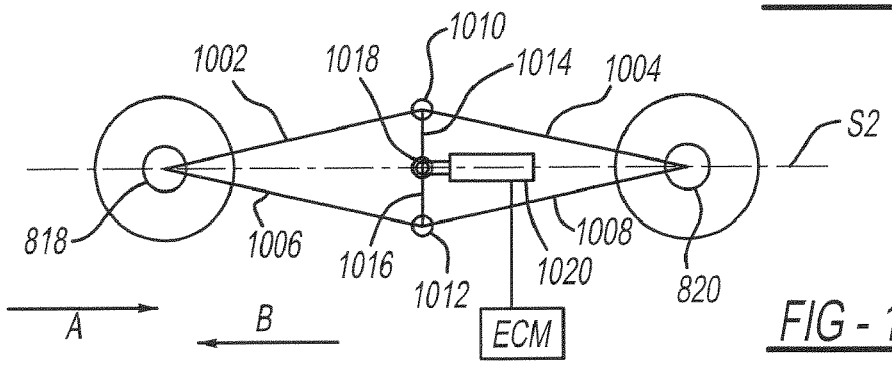

Referring to FIGS. 12*a* and 12*b*, in one particular embodiment 1000 of the compression ratio control mechanism, each link of a series of links or connecting rods 1002, 1004, 1006, and 1008 is rotatably connected at a first end thereof to one of crankshafts 818 and 820. Links 1002 and 1004 are also rotatably connected to each other at a joint 1010, and links 1006 and 1008 are rotatably connected to each other at a joint 1012. In addition, a link 1014 is rotatably connected to links 1002 and 1004 via joint 1010, and a link 1016 is rotatably connected to links 1006 and 1008 via joint 1012. Links 1014 and 1016 are also rotatably connected to each other at a joint 1018. In the embodiment shown, a rotational axis of links 1014 and 1016 through joint 1018 lies on an axis S2 connecting the rotational centerlines of crankshafts 818 and 820. Motion joint 1018 is constrained such that the joint only moves along axis S2, and a suitable linear actuator 1020 is operatively coupled to joint 1018 for controlling a linear motion of link 1018 along axis S2.

The type of actuator used should be capable of exerting the forces required for the purposes described herein, should be adaptable to various methods of control (for example, control signals received from an electronic control module), and should be capable of adjusting and maintaining the desired position of the joint 1018 over the desired range of dimensions by which the crankshaft centerline spacing is to be adjusted. Various types of hydraulic, electro-mechanical, and mechanical actuators (for example, a suitable worm or other gearing system) are contemplated. Also, motion of joints 1010 and 1012 is constrained such that the joints only move along an axis C1 responsive to motion of joint 1018 produced by actuator 1020.

In operation, when it is desired to adjust the compression ratio, actuator 1020 is controlled to move joint 1018 in a direction along axis S2. Movement of joint 1018 in direction "A" causes joints 1010 and 1012 to draw inwardly, toward axis S2. The corresponding inward movement of the ends of links 1002, 1004, 1006, 1008 connected to the joints 1010 and 1012 produces a corresponding increase in the spacing between the crankshafts 818 and 820 rotatably connected to the other ends of links 1002, 1004, 1006, 1008. This increase in spacing increases the distance between the "top dead centers" of the pistons in the chamber 812, thereby decreasing the compression ratio.

Conversely, movement of joint 1018 in direction "B" causes joints 1010 and 1012 to move outwardly, away from axis S2. The corresponding outward movement of the ends of links 1002, 1004, 1006, 1008 connected to the joints 1010 and 1012 produces a corresponding decrease in the spacing between the crankshafts 818 and 820 rotatably connected to the other ends of links 1002, 1004, 1006, 1008. This decrease in spacing decreases the distance between the "top dead centers" of the pistons in the chamber 812, thereby increasing the compression ratio.

Figure 14A:
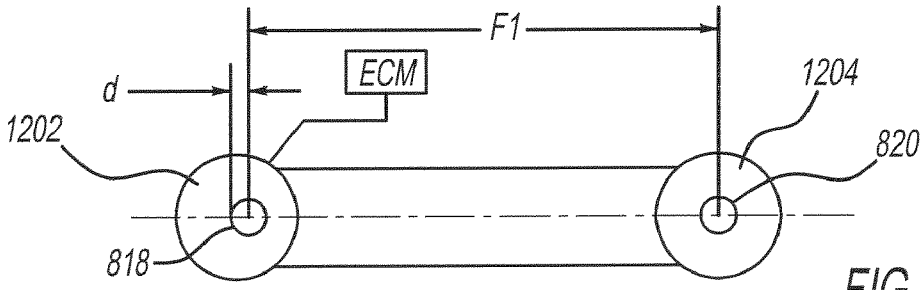
FIGS. 14A and 14B are schematic views of an engine compression ratio control mechanism in accordance with one embodiment of the present invention.
Figure 14B:
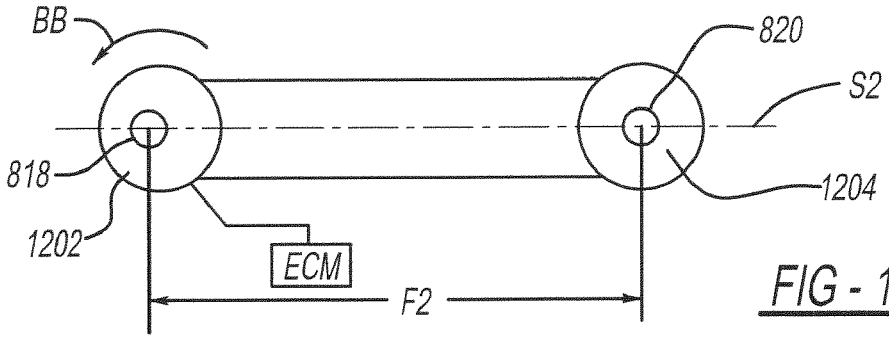

Referring to FIGS. 14*a* and 14*b*, in another particular embodiment 1200 of the compression ratio control mechanism, one or more of the bearings (not shown) mounting the crankshafts 818 and 820 to respective crankcases 814 and 816 are operatively coupled to a rotatable portion (not shown) of an associated eccentric bearing housing. In the embodiment shown in FIGS. 14*a* and 14*b*, housing 1202 is an eccentric bearing housing, which rotationally holds the shaft at a distance of d from the center of rotation of the rotational portion (not shown) of the housing. Housing 1204 is concentric. However, in other embodiments, both bearing housings may be eccentric as described herein.

To vary the spacing between the crankshaft rotational axes, the rotational portion of the bearing housings 1202 is rotated (for example, in the direction indicated by the arrow BB shown in FIG. 14*b*). FIG. 14*a* shows an embodiment wherein the rotational portion of the eccentric bearing housing is in a first rotational position. It is seen that, in this position, the crankshafts are spaced apart a relatively smaller distance F1. FIG. 14*b* shows the rotational portion in a second rotational position. It is seen that rotation of the rotational portion of the bearing housing has, due to the eccentricity of the shaft mounting, caused the crankshaft 818 to be moved father from crankshaft 820 to a distance F2 greater than F1, thereby decreasing the compression ratio. Actuation of the rotatable portion of the bearing housing may be produced by any suitable method, for example, a suitable servo-mechanism or hydraulic mechanism.

Figure 16A:
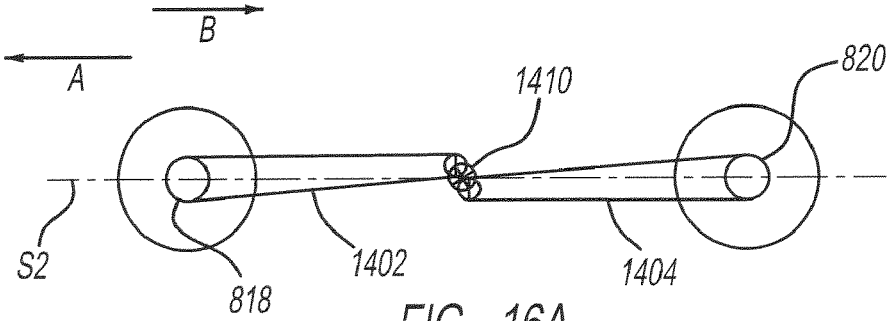
FIGS. 16A and 16B are schematic views of an engine compression ratio control mechanism in accordance with one embodiment of the present invention.
Figure 16B:
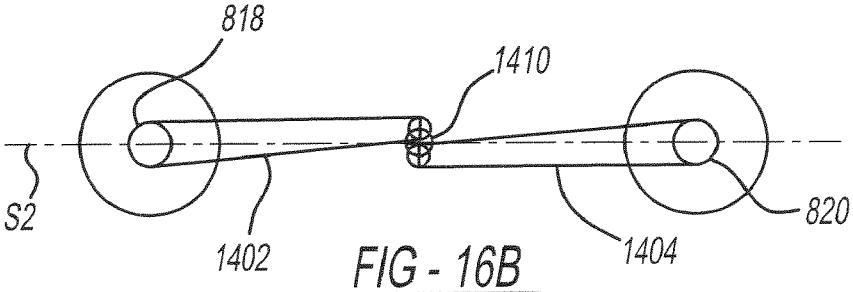

Referring to FIGS. 16*a* and 16*b*, in another embodiment, crankshafts 818 and 820 are operatively coupled via associated connecting rods or links 1402 and 1404 to a cam shaft 1410. One or more cams (not shown) positioned along camshaft 1410 engage the connecting rods during rotation of the camshaft, to urge one or more of connecting rods 1402 and 1404 in one of directions A or B. In FIG. 16*a*, cam shaft 1410 in a first rotational position engages the connecting rods in a manner that causes the shaft rotational axes to draw closer together, thereby increasing the compression ratio. In FIG. 16*b*, cam shaft 1410 in a second rotational position different from the first position engages the connecting rods in a manner that forces the shaft rotational farther apart, thereby decreasing the compression ratio. The camshaft may be rotated using any suitable means, such as a gear motor, servomotor, by a lever coupled to a hydraulic mechanism, or any other suitable method.

Figure 15A:
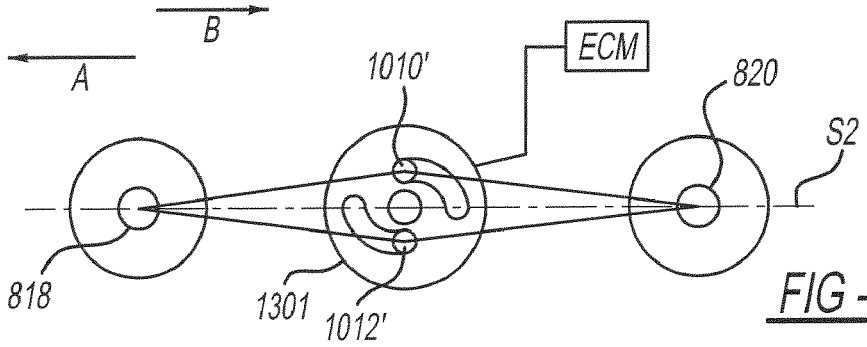
FIGS. 15A and 15B are schematic views of an engine compression ratio control mechanism in accordance with one embodiment of the present invention.
Figure 15B:
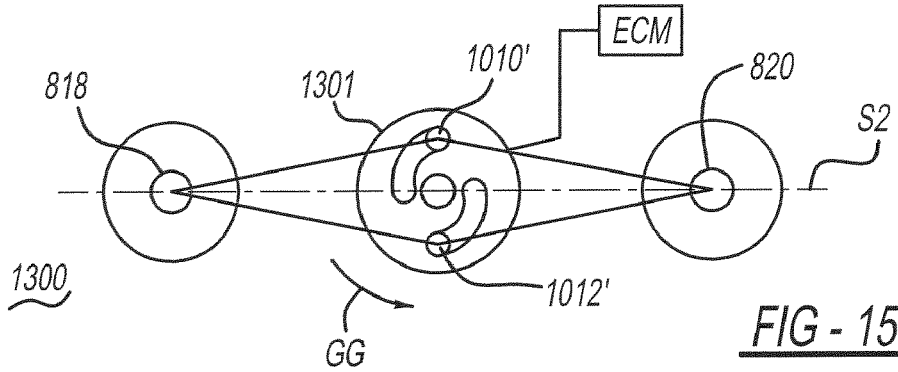

Referring to FIGS. 15*a* and 15*b*, in an embodiment 1300 similar to that shown in FIGS. 12*a* and 12*b*, the motion of joints 1010' and 1012' is controlled by a rotatable camming member 1301 or other suitable camming structure. Joints 1010' and 1012' reside in or are operatively coupled to slots 1302 and 1304 formed in camming member. In the manner described previously with respect to FIGS. 12*a* and 12*b*, rotation of camming member 1301 produces a corresponding movement of joints 1010' and 1012' either toward axis S2 or away from axis S2, thereby causing the spacing between crankshafts 818 and 820 to correspondingly increase or decrease. FIG. 15*a* shows camming member 1301 prior to rotation in a direction GG shown in FIG. 13*b*. In FIG. 15*a*, the crankshaft spacing is relatively greater. In FIG. 15*b*, after rotation of camming member 1301 in direction GG, the crankshaft spacing has decreased, thereby increasing the compression ratio.

The flexibly-coupled crankshaft(s) are operatively coupled to suitably configured associated gear trains or other motion transfer mechanism, as known in the art. The couplings between the crankshafts and their associated motion transfer mechanisms and the mountings positioning and securing the crankshafts in the crankcases may include an amount of engagement slack or clearance sufficient to permit the crankshaft to be repositioned and secured anywhere along range "X" of either shaft while still remaining operatively engaged to the motion transfer mechanism such that conversion and transmission of crankshaft motion to the other vehicle system elements is ensured.

In one particular embodiment, an electronic control module (ECM) (not shown) including a suitably configured microprocessor receives sensor signals relating to parameters (such as engine speed, intake manifold pressure, and/or any other pertinent vehicle operating parameters) usable in determining a desired compression ratio for a given engine usage scenario. The received data is processed used to generate a crankshaft spacing actuation signal. This signal is transmitted to one of the embodiments of a crankshaft spacing actuator or actuating system described herein, which may be separate from or may incorporate the ECM. In response, the actuator or actuating system adjusts the spacing between crankshafts 818 and 820 to achieve the desired compression ratio. The actuator or actuating system can maintain the desired crankshaft spacing until a different spacing is required, at which time the spacing is once more adjusted by the actuator or actuating system. Use of the ECM and suitable sensor inputs enables dynamic adjustment of the compression ration responsive to rapidly changing conditions of vehicle and engine use.

In particular embodiments, the actuating system(s) for either reducing or increasing the spacing between the crankshaft rotational axes include one or more hydraulic actuators incorporated into a hydraulic circuit (not shown) including hydraulic system elements (such as a pump, valving, fluid reservoir, etc.) necessary for operating the hydraulic actuator as required. Alternatively, other suitable actuating mechanisms (such as screw drives, gear systems, etc.) may be employed.

In a particular embodiment, the engine is configured and mounted in the vehicle so that either (or both) of crankshafts 818 and 820 may be repositioned to control the shaft spacing. This can reduce the amount by which either individual crankshaft must be moved to achieve a desired spacing.

Embodiments of the compression ratio control mechanism described herein may be employed in any opposed piston engine design incorporating crankcases, a cylinder case and crankshafts amendable to movement and in the manner described herein during operation of the engine.

Methods and systems described herein for controlling the crankshaft spacing may also be employed in other types of engines (for example, diesels) and may also be used in two-stroke engines.

It will be understood that the foregoing descriptions of the embodiments of the present invention are for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

We claim:

1. A method for adjusting a compression ratio of a horizontally opposed piston engine to a desired compression ratio comprising:

providing a first crank shaft contained within a first crank case;

providing a second crank shaft contained within a second crank case;

providing a cylinder case in threaded communication with the first and second crank cases;

receiving sensor signals, from engine sensors, that correspond to a position of the first and second crank shafts at an electronic control module (ECM) that is incorporated into an actuating system;

processing the operating parameters at the ECM based on the received, sensed signals and generating a crankshaft spacing actuation signal based on the processed parameters;

transmitting, by the ECM, the generated actuation signal to an actuating device of the actuating system; and adjusting a spacing, by the actuation device, between the first and second crank shafts based on the generated actuation signal by moving at least one of the crank shafts about the cylinder case to a predetermined position to modify the size of an associated combustion chamber contained within the cylinder case.

2. The method as in claim 1 further comprising adjusting the compression ratio of the engine to the desired ratio by adjusting the spacing.

3. A horizontally opposed piston engine comprising:

a first crank case contained within the opposed piston engine;

a second crank case contained within the opposed piston engine and opposed to said first crank case;

a first crank shaft contained within said first crank case;

a second crank shaft contained within said second crank case;

a cylinder case in in threaded communication with the first and second crank cases;

an electronic control module (ECM), that is incorporated into an actuating system, that receives sensor signals from sensors of the engine that correspond to a position of the first and second crank shafts, processes the operating parameters based on the received, sensed signals, generates a crankshaft spacing actuation signal based on the processed parameters, and transmits the generated actuation signal to an actuating device of the actuating system; and the actuating device that adjusts a spacing between the first and second crank shafts based on the generated actuation signal by moving at least one of the crank shafts about the cylinder case to a predetermined position to modify the size of an associated combustion chamber contained within the cylinder case.

4. The engine of claim 3 wherein the ECM further adjusts a compression ratio of the engine to a desired ratio by adjusting the spacing.

5. A method of adjusting a compression ratio of a horizontally opposed piston engine to a desired compression ratio, comprising:

providing a first crank case and a second crank case opposed to the first crank case within the engine;

providing a first crank shaft contained within said first crank case, and, providing a second crank shaft contained within said second crank case;

providing a cylinder case in threaded communication with the first and second crank cases;

receiving sensor signals from sensors of the engine that correspond to position of the first and second crank shafts at an electronic control module (ECM) that is incorporated into an actuating system of the engine;

processing the operating parameters at the ECM, generating a crankshaft spacing actuation signal based on the processed parameters, and transmitting the generated actuation signal to an actuating device of the actuating system; and adjusting a spacing between the first and second crank shafts, by an actuating device, based on the generated actuation signal by moving at least one of the crank shafts about the cylinder case to a predetermined position to modify the size of an associated combustion chamber contained within the cylinder case.

6. The method as in claim 5 further comprising adjusting the compression ratio of the engine to the desired compression ratio by adjusting the spacing.

7. An actuating system for determining a desired compression ratio of a horizontally opposed piston engine, comprising:

an incorporated electronic control module (ECM) comprising, an electronic processor that, receives sensor signals, from sensors of the engine, that correspond to position of the first and second crankshafts, processes the received signals and generating a crankshaft spacing actuation signal for adjusting a spacing between two crankshafts of the engine based on the processed signals; and transmits the generated actuation signal to an actuating device, and an actuating device that adjusts the spacing between the two crank shafts of the engine based on the generated actuation signal by moving at least one of the crank shafts about a respective cylinder case in threaded communication with the crank cases to a predetermined position to modify the size of an associated combustion chamber contained within the cylinder case.

8. The system of claim 7 wherein the actuating system adjusts a compression ratio of the engine to the desired ratio by adjusting the spacing.

* * * * *